United States Patent [19]

VanOrmer

[11] 4,416,642

[45] Nov. 22, 1983

[54] METHOD FOR PREVENTING BLOCKED APERTURES IN A CATHODE RAY TUBE CAUSED BY CHARGED PARTICLES

[75] Inventor: David D. VanOrmer, Lancaster, Pa.

[73] Assignee: RCA Corporation, New York, N.Y.

[21] Appl. No.: 287,563

[22] Filed: Jul. 28, 1981

[51] Int. Cl.[3] ..... H01J 9/20

[52] U.S. Cl. ..... 445/11; 445/14; 445/58

[58] Field of Search ..... 445/6, 9, 11, 14, 19, 445/58

[56] References Cited

U.S. PATENT DOCUMENTS

| | | | |
|---|---|---|---|
| 2,624,450 | 1/1953 | Britten et al. | 206/0.4 |
| 3,669,567 | 6/1972 | Porta et al. | 417/48 |
| 3,712,699 | 1/1973 | Syster | 316/2 |
| 3,792,300 | 2/1974 | Benda et al. | 313/85 R |
| 3,979,166 | 9/1976 | Zucchinelli | 417/48 |
| 4,221,991 | 9/1980 | Speigel | 313/481 |
| 4,225,805 | 7/1980 | Smithgall et al. | 313/481 |

FOREIGN PATENT DOCUMENTS

| | | | |
|---|---|---|---|
| 139462 | 10/1979 | Japan | 445/59 |

*Primary Examiner*—Kenneth J. Ramsey

*Attorney, Agent, or Firm*—Eugene M. Whitacre; Dennis H. Irlbeck; Vincent J. Coughlin, Jr.

[57] ABSTRACT

A method is proposed for preventing so-called halo-blocked apertures in color picture tubes. The halo-blocked apertures are caused by insulative negatively-charged particles attached to the inside surface of the shadow mask which deflect the transmitting portions of an electron beam. The method comprises depositing a conductive primary metal film on the insulative particle to render the particle conductive so that the particle cannot deflect the beam. This conductive film is applied during the initial tube processing after the tube has been agitated and oriented so as to dispose any loose insulative particles within the tube to a location where the conductive primary metal film can be deposited thereon, and prior to the step of depositing a getter material.

1 Claim, 1 Drawing Figure

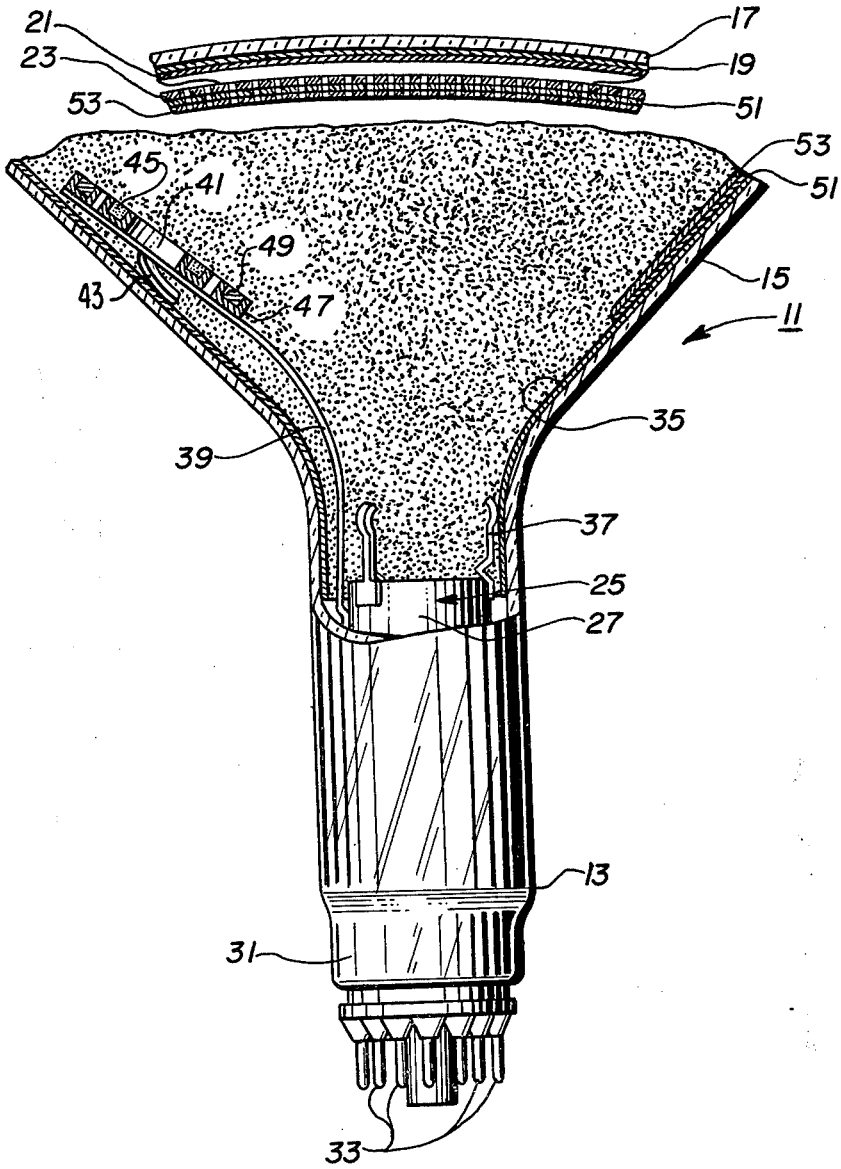
21
23
53
17
19
51
53
51
45
41
49
43
47
15
11
35
39
37
25
27
13
31
33

METHOD FOR PREVENTING BLOCKED APERTURES IN A CATHODE RAY TUBE CAUSED BY CHARGED PARTICLES

BACKGROUND OF THE INVENTION

This invention relates to a novel method for preventing blocked apertures caused by charged particles on a shadow mask of a cathode-ray tube and more particularly to a method for producing cathode-ray tubes in which insulative particles within the tube, and especially insulative particles attached to the beam intercepting interior surface of the shadow mask, are rendered conductive during tube processing.

During the manufacturing and handling of a cathode-ray tube, both conductive and nonconductive particles may be trapped or generated within the tube. Typical rejection rates due to such particles average about ½ of 1 percent for new tubes and as high as 5 to 10 percent for reworked tubes. Conductive particles include carbonized fibers, soot, aluminum flakes and weld splash. Nonconductive or insulative particles usually comprise glass, fibers and phosphor. Glass particles may be introduced into the tube during the reworking of tubes when the tubes are renecked, or the glass particles may be generated inside both new or reworked tubes, for example, from cracked stem fillets, or mechanical damage from the friction of the bulb spacer snubbers against the glass during gun insertion.

Conductive particles cause picture imperfections such as dark spots on the screen if the particles physically block the apertures in the shadow mask. The spots or shadows from conductive particles blocking the shadow mask apertures will appear on the screen to be approximately the same size as the particles in the mask apertures.

On the other hand, insulative particles which are charged negatively by the electron beams will cause deflection of the beams by coulomb repulsion. Therefore, these particles can cause picture imperfections such as screen spots when attached to the mask without physically blocking the mask apertures. Furthermore, it has been observed that the insulative particles, in addition to causing screen spots, also cause color misregister of the electron beams. The color misregister creates a "halo" effect or "halo-blocked aperture" resulting from the electron beams being deflected and striking the phosphor elements surrounding the obscured region.

An apparatus for removing charged particles from a conductive element, such as a shadow mask, of a cathode ray tube is described in U.S. Pat. No. 3,712,699 issued on Jan. 23, 1973 to Syster. The apparatus requires that the vacuum intergrity of the tube be interrupted by removing the neck portion of the tube. As pointed out herein, the renecking or rework operation is a major cause of particle scrap so the apparatus disclosed in the Syster patent is only a partial solution to the problem.

Thus, an improved procedure is required to handle insulative particles that are attached to a shadow mask of a color picture tube.

SUMMARY OF THE INVENTION

An improved cathode-ray tube comprises an evacuated envelope, having within the envelope a luminescent viewing screen, means for producing at least one electron beam for exciting the screen to luminescence and an apertured mask closely spaced from said screen for selectively intercepting and transmitting portions of said electron beam. Gettering means are provided for coating the mask with a gas-sorbing, conductive getter material film. The improvement comprises depositing a primary metal film between the mask and the getter material film.

BRIEF DESCRIPTION OF THE DRAWINGS

The FIGURE is an enlarged fragmentary partially broken-away longitudinal view of a cathode-ray tube incorporating the novel tube structure.

DESCRIPTION OF THE PREFERRED EMBODIMENT

The cathode-ray tube illustrated in the FIGURE is an apertured-mask-type color television picture tube. The tube comprises an evacuated envelope 11 including a cylindrical neck 13 extending from the small end of a funnel 15. The large end of the funnel 15 is closed by a faceplate panel 17, only a portion of which is shown. A luminescent tricolor mosaic screen 19, which is backed by a reflecting metal layer 21 of aluminum metal, is supported on the inner surface of the panel 17. The screen comprises a multiplicity of trios, each comprising a green-emitting, a red-emitting and a blue-emitting element. A shadow mask 23, only a portion of which is shown, is supported within the envelope close to the screen to achieve color selection. The mask is a metal sheet having an array of apertures therethrough which are systematically related to the trios of the screen 19. An electron gun mount assembly 25 comprising an array of three similar electron guns for generating three electron beams is mounted in the neck 13. The mount assembly includes a convergence cup 27, which is that element of the mount assembly closest to the screen 19. The end of the neck 13 is closed by a stem 31 having terminal pins or leads 33 on which the mount assembly 25 is supported and through which electrical connections are made to various elements of the mount assembly 25.

An opaque, conductive funnel coating 35 comprising graphite, iron oxide and a silicate binder on the inner surface of the funnel 15 is electrically connected to the high-voltage terminal or anode button (not shown) in the funnel 15. Three bulb spacers 37 are welded to and connect the convergence cup 27 with the funnel coating 35. The bulb spacers 37, which are preferably made of spring steel, also center and position the extended end of the mount assembly 25 with the longitudinal axis of the tube.

A getter assembly comprises an elongated spring 39, which is attached at one end to the cup 27 of the mount assembly 25 and extends in cantilever fashion onto the funnel 15. A metal getter container 41 is attached to the other extended end of the spring 39, and a sled including two curved runners 43 is attached to the bottom of the container 41. The container has a ring-shaped channel containing getter material 45 with a closed base facing the inner wall of the funnel 15. The spring 39 is a ribbon of metal which urges the base of the container 41 outwardly toward the funnel wall with the runners 43 contacting the coating 35. The length of the spring 39 permits the container 41 to be positioned well within the funnel 15, where the getter material can be flashed (vaporized) to provide optimum converage and where the spring 39 and container 41 will be out of the paths of the electron beams issuing from the mount assembly 25 without interfering with the operation of the tube.

As shown in the FIGURE, the tube is assembled and the envelope has been evacuated of gases and hermetically sealed. This may be achieved by any of the known fabrication and assembly processes.

The getter container 41 holds a mixture of nickel and a barium-aluminum alloy, which upon heating reacts exothermically, vaporizes barium metal and leaves a residue of an aluminum-nickel alloy and barium metal in the container 41.

Prior to vaporizing the barium metal, the tube is agitated to dislodge insulative particles and to transport the particles into the funnel portion 15 of the envelope. The tube may be oriented faceplate-down so that the particles are disposed on the interior surface of the shadow mask 23 or the tube may be oriented so that the particles are collected within the funnel 15 opposite the getter assembly.

As shown in the FIGURE, an evaporator assembly comprising an evaporator container 47 having a ring-shaped channel with a closed base is attached to the extended end of the spring 39 concentrically around the getter container 41. A conductive material 49, having a melting temperature lower than that of the container 47 and the getter material 45, is disposed within the channel of the container 47. In a preferred embodiment, the conductive material 49 comprises magnesium. To evaporate a magnesium film 51 on the interior surface of the mask 23 and on at least a portion of the funnel coating 35 containing the collected insulative particles, an induction coil (not shown) is externally located proximate to the evaporator container 47. The induction coil, by induction, will heat the evaporator container 47 and the magnesium material 49 until the magnesium material vaporizes. The magnesium vapor will condense on the interior surfaces of the tube within the line-of-sight of the magnesium source 49 to provide a substantially uniform and continuous metal film. The insulative particles disposed within the tube on either the interior surface of the shadow mask 23 or on the funnel coating 35 opposite to the evaporator container 47 will also be rendered conductive and, in some instances, may be secured by the magnesium film 51 to the interior surfaces on which they are disposed.

To "flash" the getter; that is, to cause the exothermic reaction to take place, use is made of the externally-located induction heating coil. The induction coil will heat the getter container 41 and its contents 45 until the contents flash, releasing barium vapor. The barium vapor deposits as a gas-sorbing barium metal layer 53, principally on the primary magnesium film 51 previously deposited on the interior surface of the mask 23 and on a portion of the funnel coating 35.

By rendering the insulative particles within the tube conductive during tube processing, the incidence of halo-blocked apertures caused by electron beam charging of the insulative particles attached to the interior surface of the shadow mask is greatly reduced.

As an alternative to the above-described structure, the magnesium material may be formed into an annular ring or washer having a diameter equal to the diameter of the channel formed in the getter container 41. The magnesium ring is disposed within the getter container 41 on top of the getter material 45. In this embodiment, the magnesium endothermically evaporates from the container 41 and condenses on the insulative particles disposed upon the interior surface of the shadow mask 23 and the funnel coating 35 before the barium material 45 exothermically reacts.

During the subsequent tube processing and testing, steps include: cathode discharge ball gap (CDBG), cathode conversion, hot shot, first low voltage age, initial test, implosion proofing, external coating, frit breakdown check, radio frequency spot knock (RFSK), final low voltage age and final test, the tube is handled extensively. Such handling may mechanically transport some particles to the shadow mask 23; however, since most of the free particles within the tube were previously made conductive and many of these conductive particles are now secured to the interior surfaces of the tube by both the conductive magnesium film 51 and the barium getter film 53, only conductive particles which physically block the apertures in the shadow mask 23 will appear as dark spots on the screen. Such conductive particles can often be removed from the mask by externally-controlled means, such as mechanical vibration and heating the mask with an AC magnetic field.

What is claimed is:

1. A method of processing an evacuated cathode-ray tube having an envelope with a conductive coating disposed on an interior surface portion thereof, a luminescent viewing screen within said envelope, means for producing at least one electron beam for exciting said screen to luminescence, an apertured mask having an interior surface facing said electron beam producing means, said mask being closely spaced from said screen, an evaporator assembly for depositing a primary metal film on the interior surfaces of said funnel portion of said envelope and of said mask, and gettering means for depositing a gas-sorbing getter material film on said primary metal film, the method including the steps of:

agitating said tube so as to dislodge any insulative particles therein, orienting said tube so that any of said insulative particles are disposed upon said interior surfaces, depositing a substantially uniform and continuous primary metal film on said interior surfaces thereby rendering conductive any of said insulative particles disposed on said surfaces, and applying said gas-sorbing getter material film to said primary metal film.

* * * * *